US010934798B2

(12) United States Patent
Engene

(10) Patent No.: US 10,934,798 B2
(45) Date of Patent: Mar. 2, 2021

(54) UNMANNED OR REMOTELY OPERATED PLATFORM

(71) Applicant: Kværner AS, Lysaker (NO)

(72) Inventor: Knut Engene, Trondheim (NO)

(73) Assignee: Kværner AS, Lysaker (NO)

( * ) Notice: Subject to any disclaimer, the term of this patent is extended or adjusted under 35 U.S.C. 154(b) by 28 days.

(21) Appl. No.: 16/466,675

(22) PCT Filed: Dec. 11, 2017

(86) PCT No.: PCT/EP2017/082159
§ 371 (c)(1),
(2) Date: Jun. 5, 2019

(87) PCT Pub. No.: WO2018/104546
PCT Pub. Date: Jun. 14, 2018

(65) Prior Publication Data

US 2019/0301259 A1 Oct. 3, 2019

(30) Foreign Application Priority Data

Dec. 9, 2016 (NO) ..... 20161956

(51) Int. Cl.
*E02B 17/00* (2006.01)
*E21B 33/035* (2006.01)
(Continued)

(52) U.S. Cl.
CPC ..... *E21B 33/035* (2013.01); *E02B 17/02* (2013.01); *E02B 17/027* (2013.01); *E21B 7/128* (2013.01); *E02B 2017/0078* (2013.01)

(58) Field of Classification Search
CPC . E02B 17/0034; B63B 35/44; B63B 35/4413; B63B 2035/448
See application file for complete search history.

(56) References Cited

U.S. PATENT DOCUMENTS

2016/0221648 A1 8/2016 Labrugere

FOREIGN PATENT DOCUMENTS

GB 2515021 A 12/2014
WO WO 98/46478 A1 * 10/1998
(Continued)

OTHER PUBLICATIONS

Ing, James, "International Search Report," prepared for PCT/EP2017/082159, dated Mar. 6, 2018, four pages.
(Continued)

*Primary Examiner* — Sunil Singh
(74) *Attorney, Agent, or Firm* — Shackelford, Bowen, McKinley & Norton, LLP

(57) ABSTRACT

An unmanned wellhead platform (1) (UWP) comprising a jacket (10) designed and adapted to be supported on the seabed and projecting above the sea level is shown. The unmanned wellhead platform (1) includes a topside installed on top of the jacket (10). The topside is designed as a standardized base concept tailored for repetitive future topside constructions (3). Each topside construction (3) is adapted to the number of wells to be developed. The topside construction (3) is made up by a number of different but standardized sections (4). Each standardized section (4) is dedicated for a particular and predetermined purpose and location in the topside construction (3).

9 Claims, 10 Drawing Sheets

Figure 1:
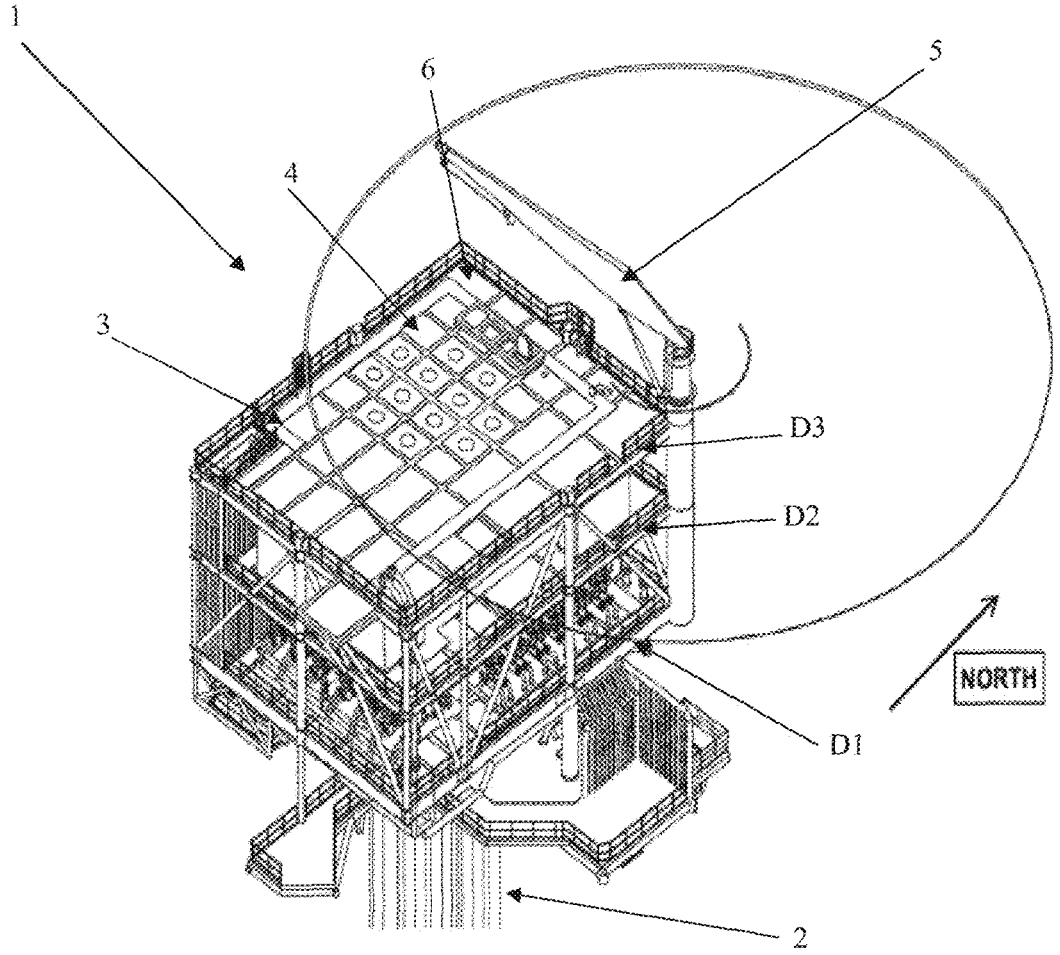

(51) Int. Cl.
*E02B 17/02* (2006.01)
*E21B 7/128* (2006.01)

(56) References Cited

FOREIGN PATENT DOCUMENTS

WO WO 2016/078662 A1 * 5/2016
WO WO-2016122334 A1 8/2016

OTHER PUBLICATIONS

Dupre, Robin, "Standardized Platform Approach Gains Momentum—Offshore," Oct. 15, 2015, URL:<http://www.offshore-mag-com/articles/print/volume-75/issue-10/production-operations/standardized-platform-approach-gains-momentum.html>, Retrieved: Feb. 26, 2018, eight pages.

* cited by examiner

UNMANNED OR REMOTELY OPERATED PLATFORM

TECHNICAL FIELD

The present invention relates to an unmanned or remotely operated platform concept. Such platforms include a jacket standing on the seabed. The jacket extends through the body of water and projects above the sea level. A topside is mounted on top of the jacket. The purpose of this platform concept is to bring the subsea infrastructure to the surface, which makes the wellheads, blow out preventer, Xmas trees, valves, actuators etc. dry and far more accessible.

The term un-manned or remotely operated platform must be interpreted broadly. The term could be an unmanned wellhead platform, an unmanned platform, remotely operated platform, normally unmanned platform, unmanned process platform or simpler facilities offshore.

Typical for these platform concepts is that the platform has no permanent manning and the concept grant options for removing typical functions as living quarters, helicopter deck and lifeboats. All these facilities may be found on a service operations vessel (SOV) that may be chosen to serve and operate the unmanned wellhead platform during eg. maintenance campaigns.

TECHNICAL BACKGROUND

There is a continuous and ongoing demand and challenge to save cost during the development of oilfields in order to extract hydrocarbons from subsea oil reservoirs in a cost-effective way. It is only in the more recent years it has been proposed to make use of the rather new concept of unmanned wellhead platforms. The alternative would have been to install the wellheads on the seabed. However, the costs of subsea wells have grown extremely the last decades. The total cost for unmanned wellhead platforms is found very beneficial in respect of the expensive subsea concept.

The overall design philosophy is to minimize the equipment on the platform, thus minimizing the requirement for visiting the platform for operation and maintenance. Visits to the platform is planned limited to once a year except for unplanned well maintenance. Further, focus is on efficient and safe evacuation if for some reason a leakage and/or fire should occur during a visit.

Publication WO2016/122334 discloses an unmanned platform supported on a structure arranged on the seabed. The platform structure of the publication is standardized so that the same platform may be used on several installation structures.

Publication US2016/0221648 discloses a floating facility for offshore hydrocarbon production with drilling slots and production slots and a cart that is movable together with a drilling riser above the well bay to drill the well through the drilling riser.

GB2515021 discloses a support structure for use in an offshore platform. The support structure comprises a main support strut having one end anchored to the seabed and guide rail extending to the top of the support strut for cooperation with a framework with a payload slidably mountable to the guide rail for elevating the frame work and payload to the top of the structure.

None of the above publications do however discloses a platform structure for an unmanned platform that is adapted and designed for possible future expansion.

SUMMARY OF THE INVENTION

According the present invention, an unmanned wellhead platform comprising a jacket design and adapted to be supported on the seabed and projecting above the sea level, which jacket includes a topside installed on top of said jacket, is provided. The unmanned wellhead platform is distinguished in that the topside is designed as a standardized base concept tailored for repetitive future topside constructions, each topside construction being adapted to the number of wells to be developed, the topside construction being made up by a number of different but standardized sections, each standardized section being dedicated for a particular and predetermined purpose and location in said topside construction.

In one embodiment, some of the standardized sections of the topside construction has defined well slots, each well slot having received its respective and unique number from one and up, each numbered well slot repeatedly receives the same location in the topside construction each time a base topside construction is constructed, hence "standardizing" such base topside construction.

The many standardized sections may adopt different sizes and configurations, though normally grouped in sets of sections having equal dimension. Even if the topside frame construction is subdivided into a number of different sections, each section has its standard in respect of size and intended use.

In one embodiment, the at least one of the standardized sections may be adapted to receive and mount various components associated with a dedicated well.

In one embodiment, the number of standardized sections are grouped in standardized structural sections and standardized equipment sections.

Each standardized section may span over at least two decks, or alternatively each standardized section may span over three decks, i.e. a cellar deck, a middle deck and a weather deck.

Further, the topside sectioned frame structure may include eight, twelve or sixteen dedicated well slots, each well slot being adapted to receive required components for one respective well. Any number of dedicated well slots are conceivable, but eight, twelve or sixteen are shown here.

In one embodiment, the topside may be rotated in the horizontal plane approximately 45 degrees relative to corner legs of the jacket. This provides benefits with regard to accessibility and reach for a jack-up rig (not shown) to be located adjacent to the unmanned wellhead platform. The legs of the jack-up rig are able to straddle over the corner leg of the jacket and in this way being able to arrive as close as possible to the unmanned wellhead platform topside construction and thus the well area.

In one embodiment, the topside construction is adapted and designed for possible future expansion, where such expansion takes place by adding one or more structural section elements as required.

SHORT DESCRIPTION OF THE DRAWINGS

Figure 2:
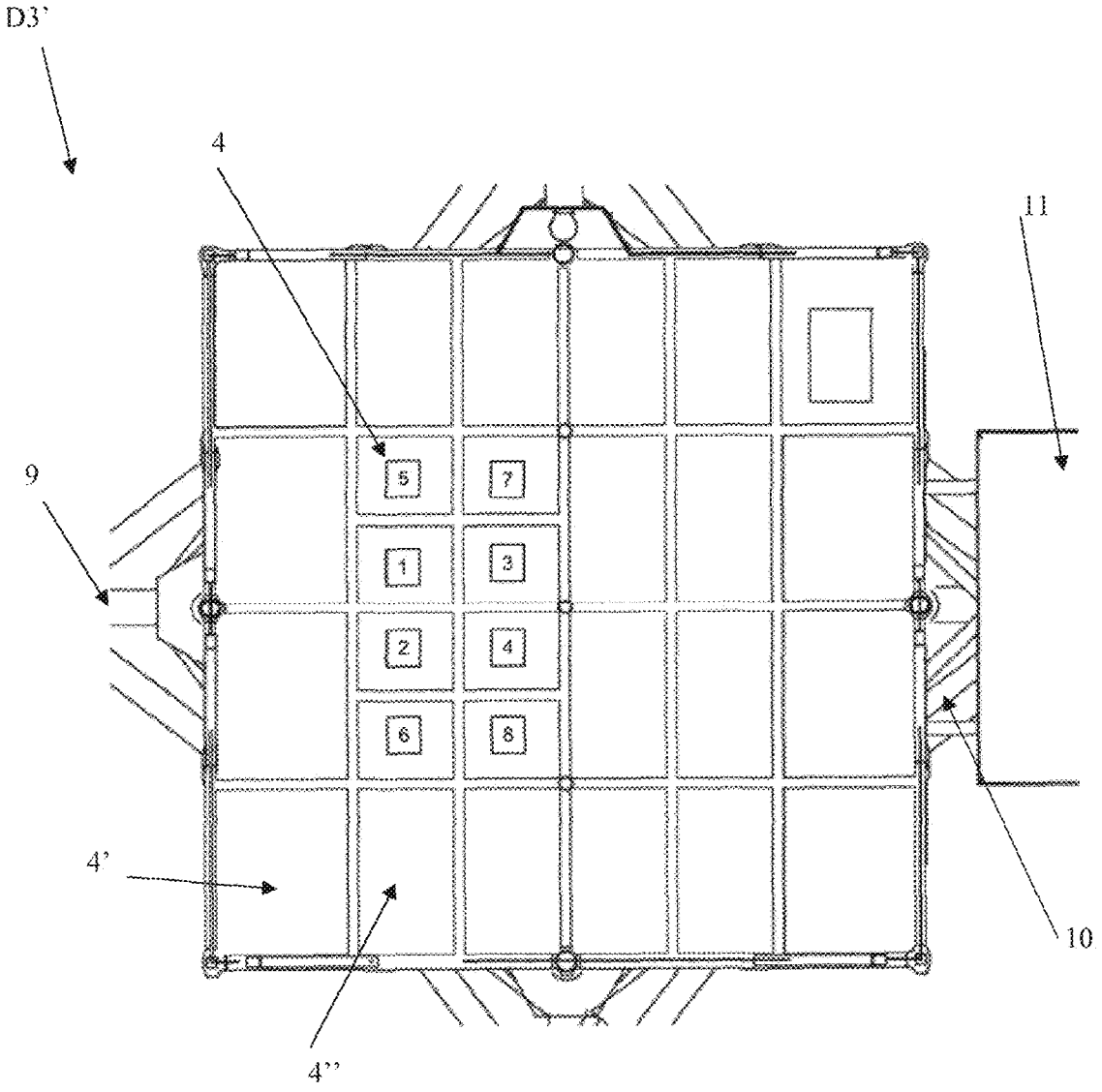
Figure 3:
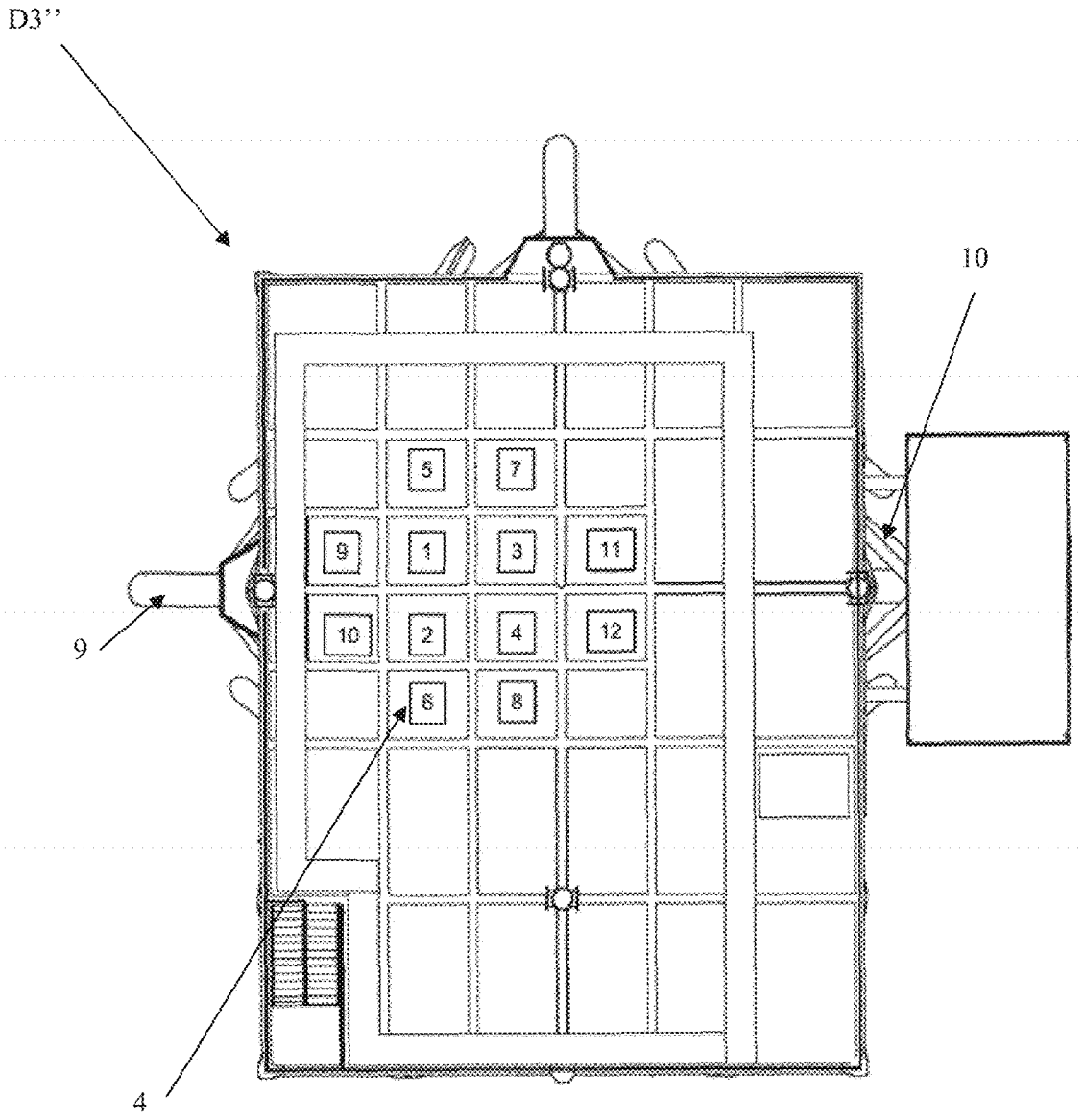
Figure 4:
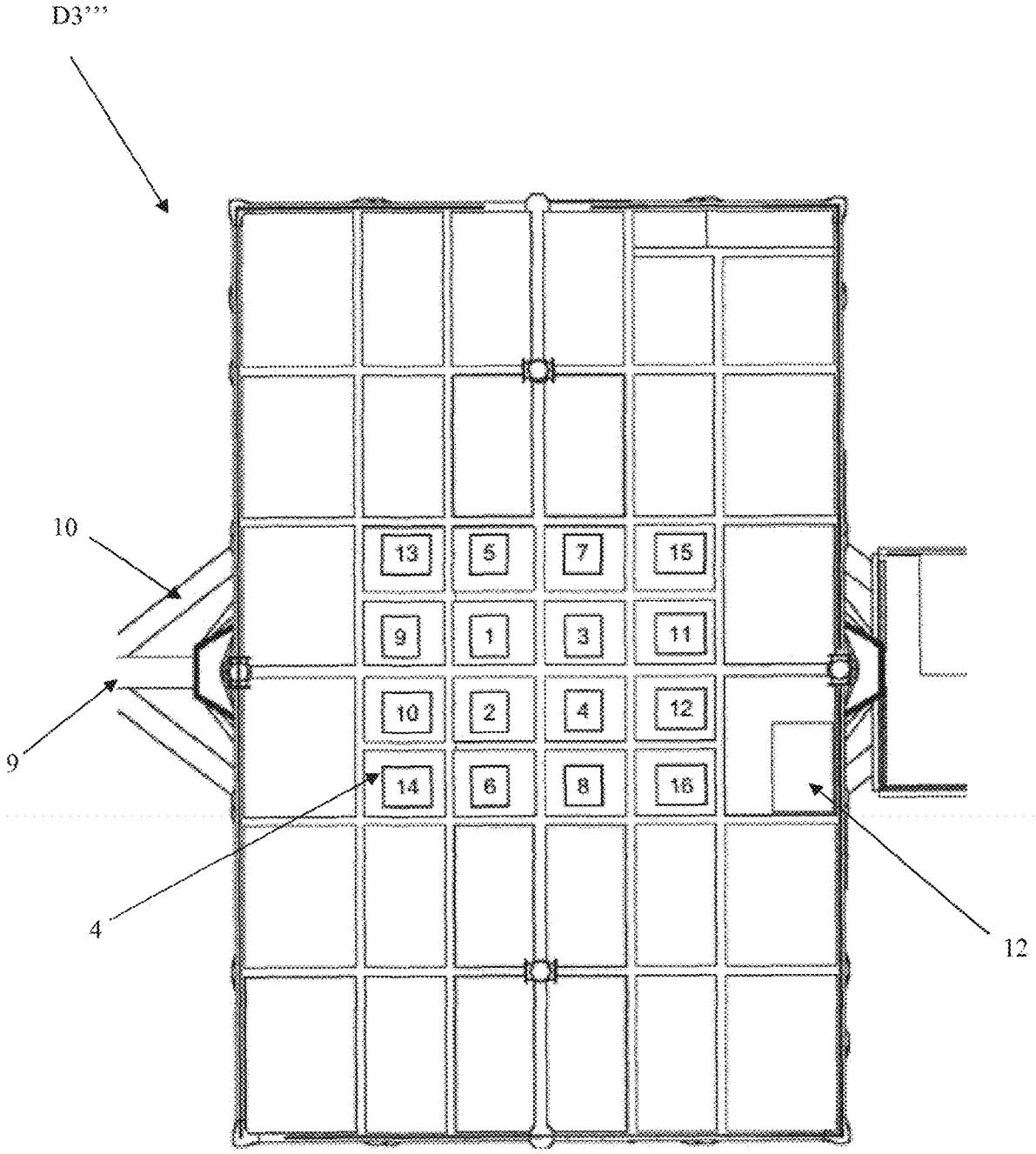
Figure 5:
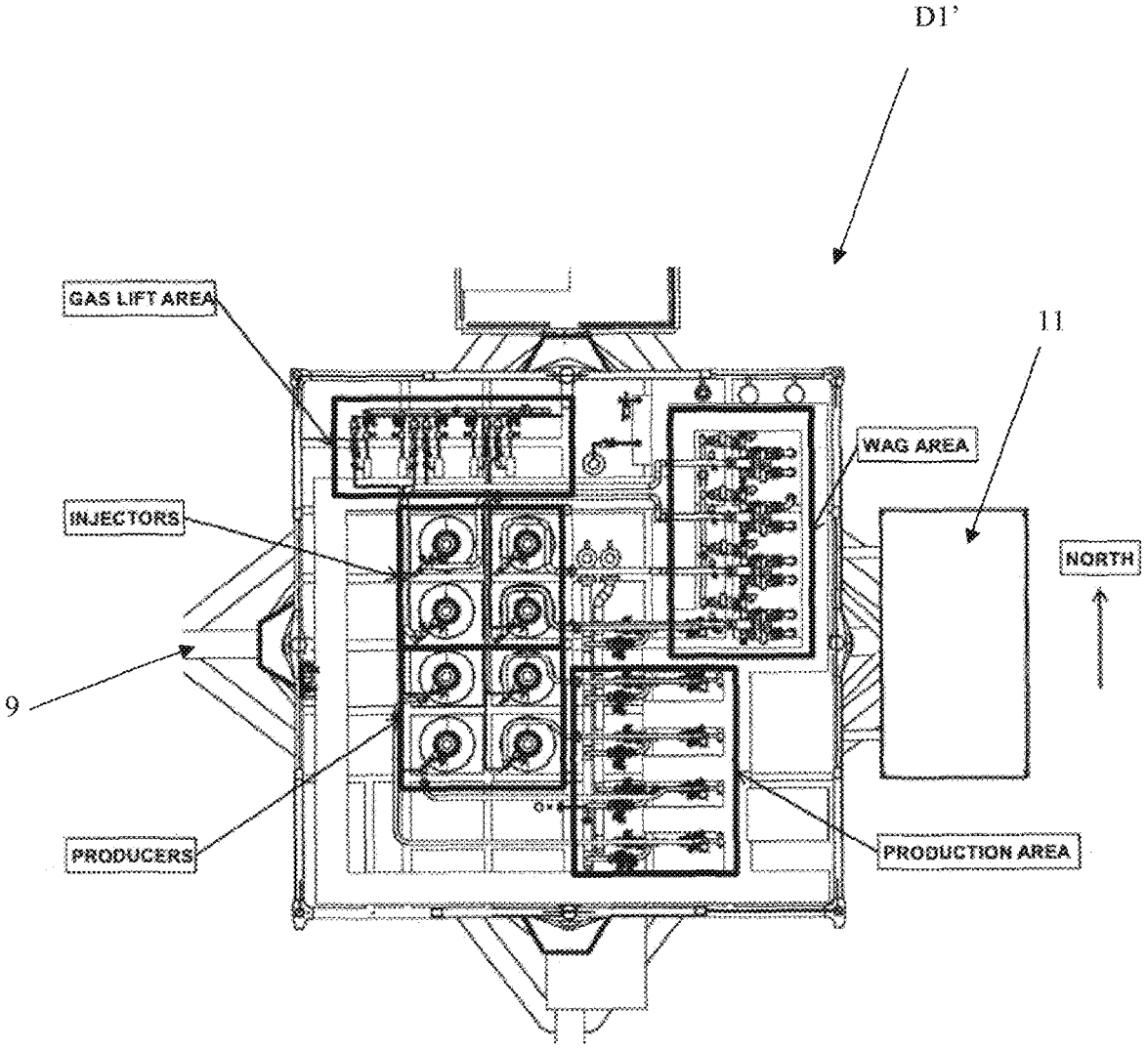
Figure 6:
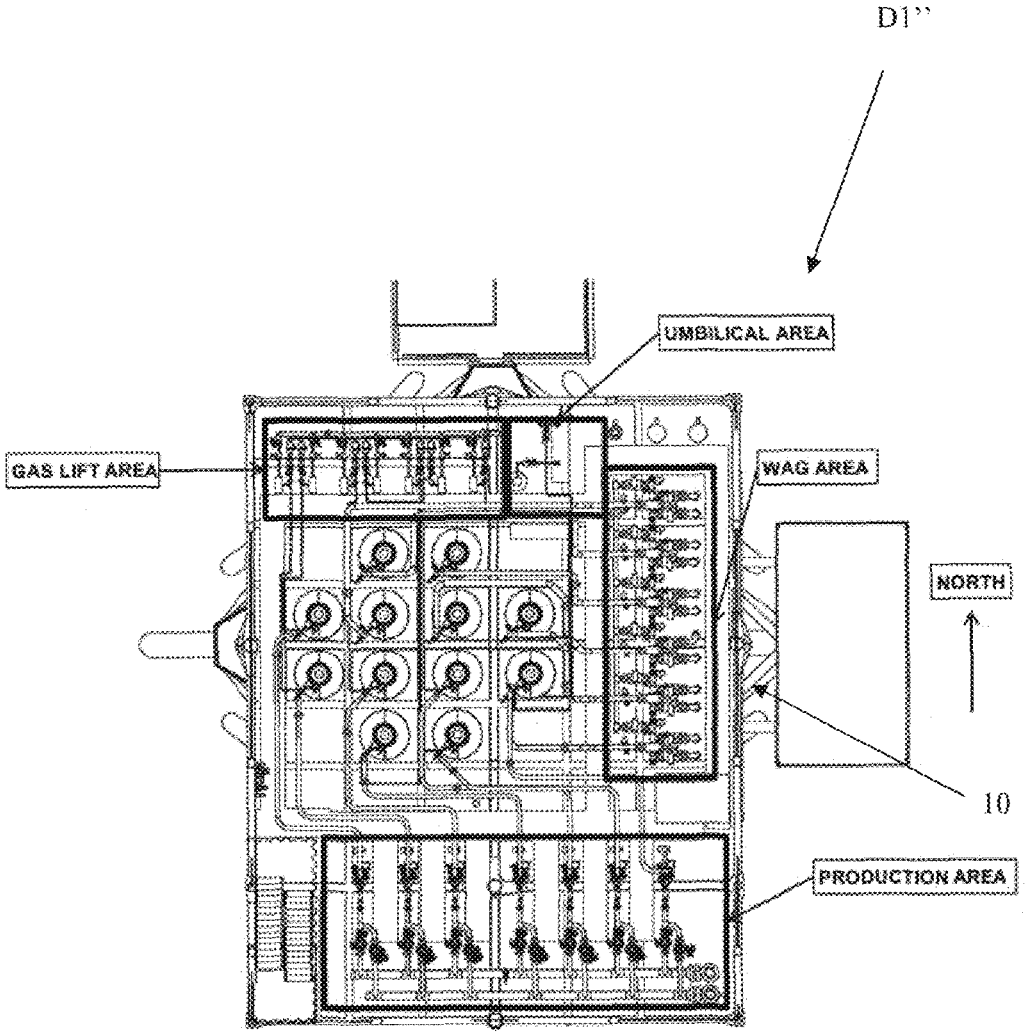
Figure 7:
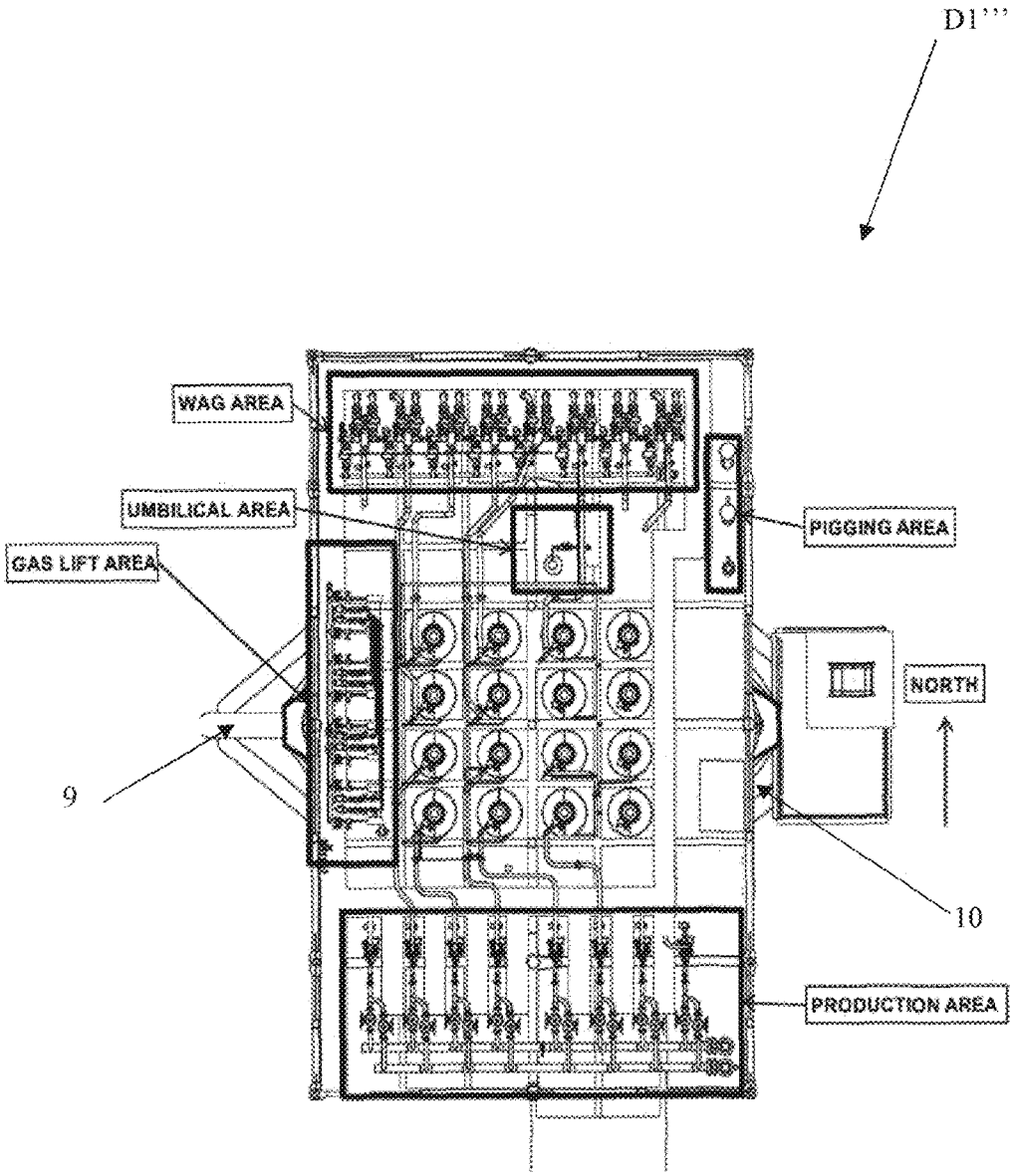
Figure 8A:
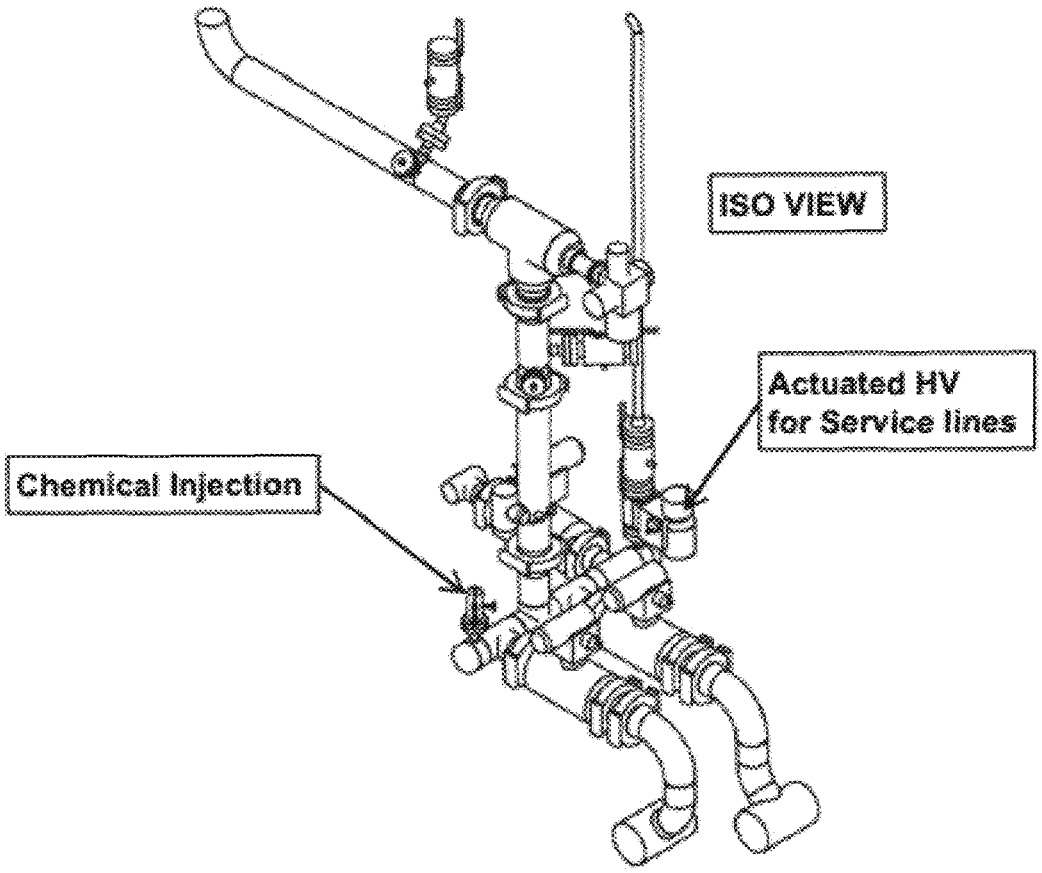
Figure 8B:
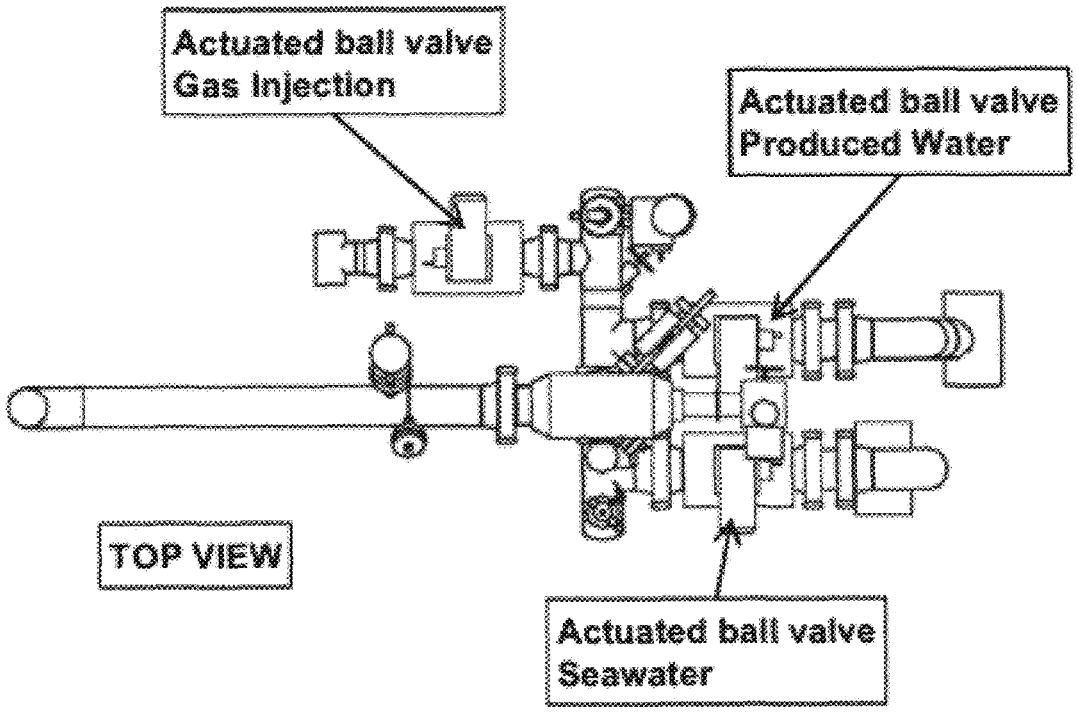
Figure 9:
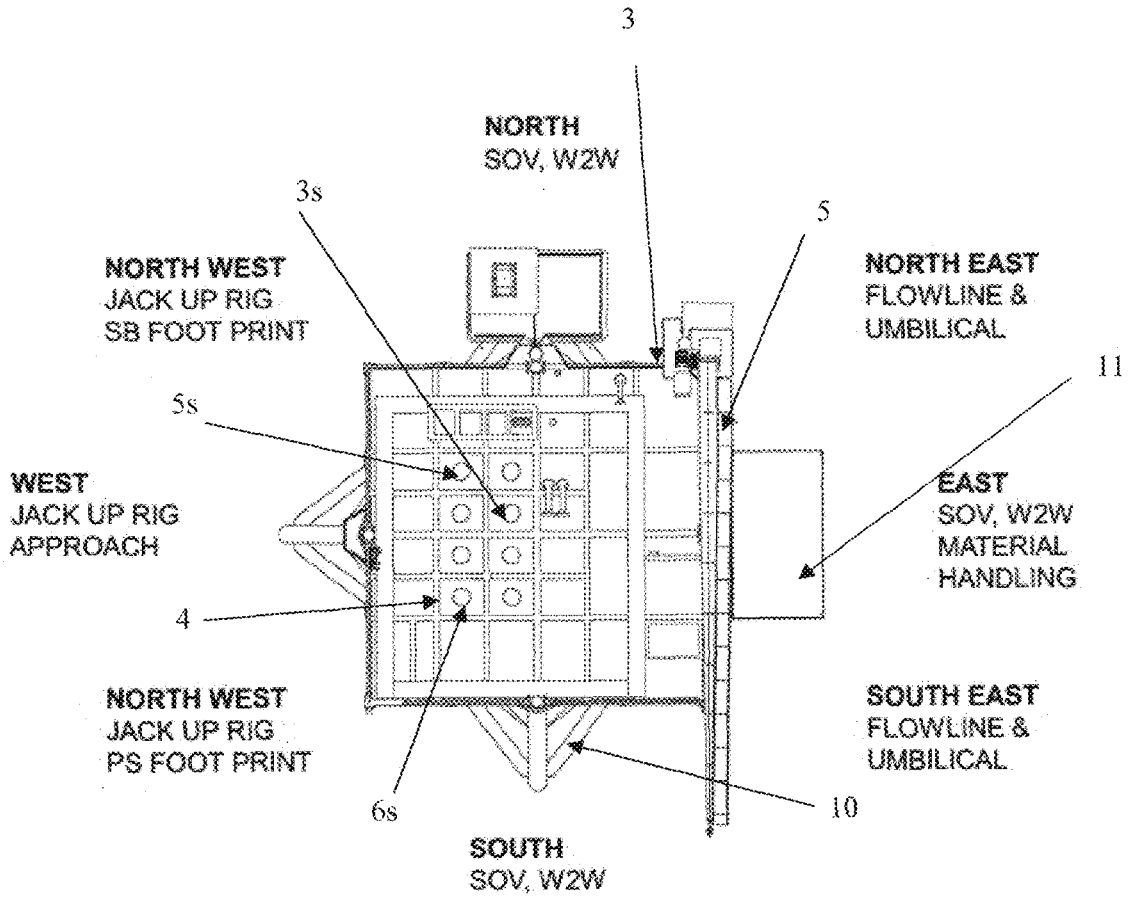

While the various aspects of the present invention have been described in general terms above, a more detailed and non-limiting example of embodiments will be described in the following with reference to the drawings, in which:

FIG. 1 shows a schematic perspective view an unmanned wellhead platform according to the present invention, FIG. 2 shows a schematic top view of a first embodiment of the unmanned wellhead platform shown in FIG. 1, the platform having 8 well slots, FIG. 3 shows a schematic top view a second embodiment of the unmanned wellhead platform shown in FIG. 1, the platform having 12 well slots, FIG. 4 shows a schematic top view a third embodiment of the unmanned wellhead platform shown in FIG. 1, the platform having 16 well slots, FIG. 5 shows a schematic view from above the first embodiment shown in FIG. 2, and with the top deck (weather deck and xmas deck) removed, FIG. 6 shows a schematic view from above the second embodiment shown in FIG. 3, and with the top deck (weather deck and xmas deck) removed, FIG. 7 shows a schematic view from above the third embodiment shown in FIG. 4, and with the top deck (weather deck and xmas deck) removed, FIG. 8*a* shows a principal view an exemplary layout of various pipes and components onboard said platform, view from the side FIG. 8*b* shows a principal view of an exemplary layout of various pipes and components onboard said platform, viewed from above, FIG. 9 shows in schematic view a typical field layout.

DETAILED DESCRIPTION OF THE INVENTION

Reference is made to FIG. 1 showing an unmanned wellhead platform 1. The platform, or more precisely a topside 3, is installed on top of a jacket 10 (FIG. 2). The jacket 10 is designed with legs 9 (FIG. 2) and adapted to be supported on the seabed. The jacket 10 is secured to the seabed by suction buckets (anchors) or piles. The jacket 10 is normally a truss structure projecting above the sea level to support the topside frame construction 3 on top of the jacket structure. A number of risers 2 extend from the seabed up to the topside 3. The topside frame construction 3 further includes a swing crane 5 having reach all over the top deck floor 6.

Basically, the topside frame construction 3 is designed as a frame construction (also numbered 3), normally made up by several decks, here three decks are shown. The lowest deck is a cellar deck $D_1$, next is a XMT deck $D_2$ and weather deck $D_3$ on top. The top area can easily be expanded or diminished.

The topside frame construction 3 is designed as a standardized base concept. This means that the concept is prepared for repetitive future use. However, the topside frame construction 3 needs to be adapted to each project depending on the number of wells to be operated and the site where it is to be located. The topside frame construction 3 could be adjusted according to the number of wells that are needed. This could be any number from 1-16. Further the number of decks are adjusted. The deck area and the height between the decks are defined accordingly.

The topside frame construction 3 is divided into a number of sections 4. Each section 4 is standardized in respect of size and intended use. However, even if many sections 4 are equal, many sections 4 are different also. Hence, they are grouped into particular sizes, but each size is standardized. Each section size is dedicated for a particular and predetermined purpose and location in the topside frame construction 3. Example of purpose and location are shown in FIG. 5-7, and in the description below referring to the figures.

FIG. 2-4 shows three different embodiments of D3, namely D3', D3", D3''' of the weather deck of the topside frame construction 3.

As more clearly shown in FIG. 2, some of the standardized sections 4 of the topside construction 3 has defined well slots $\mathbf{1}_S$ to $\mathbf{8}_S$. Each well slot has received its unique number. For future eight well slots topside frame constructions 3 to be built, each numbered well slot $\mathbf{1}_S$-$\mathbf{8}_S$ repeatedly receives exact the same location in the topside frame construction 3. Thus, such base topside frame constructions 3 are named as "standardized".

The number of standardized sections 4 can be grouped in sets of equal sections, though the sections may adopt different sizes and configurations in the various sets. Two coarsely divided groups of sections can be "standardized structural sections" and "standardized equipment sections", as an example. In FIG. 2 they are numbered 4' and 4" respectively.

At least one of the standardized sections 4 is adapted to receive and mount various components associated with a dedicated well.

In the embodiment shown in FIG. 2, the topside construction 3 is rotated in the horizontal plane approximately 45 degrees relative to corner legs 9 of the jacket structure 10. This provides benefits with regard to accessibility and reach for a jack-up rig (not shown) to be located adjacent to the unmanned wellhead platform 1. The legs of the jack-up rig are able to straddle over the corner leg 9 of the jacket 10 and in this way, being able to arrive as close as possible to the unmanned wellhead platform topside construction 3 and thus the well area. A material handling platform 11 is also shown. This platform 11 is located at a desired height above sea level. The platform 11 could be, either of the fixed design located at a higher level, or a temporary platform intended for location at a lower level closer to the sea.

As mentioned, the topside construction 3 is sectioned where the most important parameter for the total size of the topside construction 3 is the number of well slots $\mathbf{1}_S$ to $\mathbf{16}_S$. The well slots are dedicated to be either producers, injectors, flexibles (both producer and injector) and redundant.

Referring to FIGS. 2, 3 and 4, the unmanned wellhead platform typically has from two to sixteen well slots. As mentioned, the well slots numbered $\mathbf{1}_S$ to $\mathbf{16}_S$ are given a fixed location according to numerical value. For example, a ten slot unmanned wellhead platform will receive slot locations as shown in FIG. 3 up to slot number 10.

Each well slot has a set of components topside in order to be able to produce or inject the well. This is typically wellhead, XMT (Christmas tree), flow control valves, flow meters and isolation valves.

Each well slot is typically 2.5×2.5 meters. The wellhead and XMT are installed within this area.

The topside construction 3 is sectioned with predetermined location and design of the respective sections 4.

As mentioned, the sections 4 can have different sizes, dependent of the number of well slots and location in the topside construction 3.

As an example, shown in FIG. 2, the topside construction 3 can be based on a 20 m×20 m deck floor 6 (FIG. 1) and in three heights (decks). This one has 2-8 wells. However, the number of wells can be expanded, for example as shown in FIG. 3 with up to four more wells. Then you need to expand the area with a row of sections 20 m×5.5 m as shown in the bottom of FIG. 3. If you expand with four more wells, as shown in FIG. 4, you need to expand the area with another row of sections 20 m×5.5 m as shown on top of FIG. 4.

Typical values for sections having four different sizes, dependent of the number of well slots, can be:

| | |
|---|---|
| 2-4 wells | 14 × 14 × 11 m (not shown) |
| 4-8 wells | 20 × 20 × 11 m (FIG. 2) |
| 9-12 wells | 20 × 25 (including cantilever in south) (FIG. 3) |
| 13-16 wells | 20 × 30 (including cantilever in north) (FIG. 4) |

The equipment has standardized layout (for example the FIG. 6 injection system), is sectioned and located in fixed locations for the respective topside sizes and scaled in accordance with the number of wells. Typical sections/areas are:

Well area, shown in the figure as producers and injectors
Production area
Injection (WAG) (Water and Gas) area
Gas lift area
Hydraulics
Electro, Instrument, control, telecom (EICT) (XMT deck, not shown on drawing)
Material handling area
Area for pigging operation equipment As an example, a water and gas/injection well on a 10 slots unmanned wellhead platform then will have:

Layout of flow control, measurement and isolation valve as shown in FIGS. 8*a* and 8*b*
Flow control, measurement and isolation valve as shown in FIGS. 8*a* and 8*b* will be connected to a manifold in water and gas area as shown in FIG. 6.

As mentioned, the construction typically has three deck levels, cellar deck $D_1$, xmas tree deck $D_2$ and weather deck $D_3$.

On cellar deck $D_1$ (FIGS. 5, 6 and 7) the well heads (producers and injectors) are installed together with equipment for flow regulation, flow measurements, isolation valves, manifolds, gas lift etc in the different sections or area as shown in the figures.

FIG. 5-7 discloses three different embodiments D1', D1", D1"' of the cellar deck of the topside frame structure 3. The embodiments corresponding to the weather deck D3', D3", D3"' as disclosed above in FIG. 2-4.

On xmas tree deck $D_2$, the xmas tree is placed together with equipment for power supply (electro), control systems, inlet of umbilical from the mother platform, injection systems.

The weather deck $D_3$ has hatches 12 for access to the various wells. The weather deck D3 shields the well area and operates as base for connection to the wells for conducting well intervention. On the weather deck $D_3$ there are room for a pig skidder. The pig skidder can easily be connected to a temporary piping spool connected to the risers 2 down at the cellar deck $D_1$. The pig skidder is arranged to launch or receive a plug device that is forced through the pipeline system for cleaning purpose after the installation and before the start production/operation of the platform.

As an Example, one global layout is shown in FIG. 9. What shown is:

A Jack-up Rig (JUR) approaching from windward side; minimize the jack up rig (JUR) exposure of potential gas leakage during drilling and well operations.
Service operation vessel (SOV) approach from leeward side; minimize risk for SOV interference with the unmanned wellhead platform in case of e.g. Dynamic positioning (DP) failure
Flowline and umbilical routing to avoid conflict with jack-up rig footprint
Four possible SOV headings for simultaneous material handling from SOV and Walk to work (W2W) connected to the unmanned wellhead platform. The walk to work is a bridge landing system for use between a fixed installation and a floating vessel for personnel transfer.
Dropped object protection above flowlines and umbilical close to the unmanned wellhead platform might be required The hook-up philosophy is as follows. It is kept at a minimum, only risers and J-tubes are required. The topside is designed for single lift offshore. This means that all components are ready installed and tested. Only hook-up spools are required to complete the connection between topside and jacket. Hook-up spools are fabricated onshore and shipped to the topside. Possible adaptions are made offshore.

The control system is preferably in an EICT container. The choice was to collect electrical and instrument cabinets within the EICT container. The size of the container can vary, it is determined by the equipment it is to contain. Primary location for such container will be in direction south on the Xmas tree deck D2, since this will provide a good air direction on Norwegian offshore sector, i.e. prevailing wind is often toward north-east. All equipment within the container are Ex secured.

The external material handling takes place either to/from Jack-Up Rig (JUR) or to/from Service Operation Vessel (SOV). Toward jack up rig (JUR) the external material handling is performed by crane located on jack up rig (JUR) and towards dedicated landing areas on the unmanned wellhead platform. Toward unmanned wellhead platform also called SOS (subsea on a stick), the external material handling takes place with crane located on SOV toward dedicated load platform on. unmanned wellhead platform Internal material handling takes place in vertical shafts typically 2 m×3 m extending from weather deck to cellar deck.

The invention claimed is:

1. An unmanned wellhead platform comprising:
a jacket configured to be supported on the seabed and projecting above the sea level;
a topside structure installed on top of the jacket and comprising at least two decks;
wherein the topside structure is expandable via the addition of one or more standardized sections, the topside structure being adapted to a number of wells to be developed, the topside structure comprising a plurality of different standardized sections, each of the plurality of different standardized sections being dedicated for a particular and predetermined purpose and location; and
wherein the plurality of different standardized sections adopt different sizes and configurations and are grouped in sets of sections having equal dimensions.

2. The unmanned wellhead platform according to claim 1, wherein some of the plurality of different standardized sections have at least one defined well slot, each well slot having received its respective and unique number from 1 (one) and up, wherein each numbered well slot repeatedly receives the same location in the topside construction each time a base topside construction is constructed.

3. The unmanned wellhead platform according to claim 1, wherein at least one of said plurality of different standardized sections is adapted to receive and mount various components associated with a dedicated well.

4. The unmanned wellhead platform according to claim 1, wherein the plurality of different standardized sections are grouped in standardized structural sections and standardized equipment sections.

5. The unmanned wellhead platform according to claim 1, wherein each of the plurality of different standardized sections spans over at least two decks.

6. The unmanned wellhead platform according to claim 5, wherein each of the plurality of different standardized sections spans over three decks, the three decks being a cellar deck, a middle deck and a weather deck.

7. The unmanned wellhead platform according to claim 1, wherein the topside structure comprises a plurality of dedicated well slots selected from eight, twelve, and sixteen dedicated well slots, each well slot being adapted to receive required components for one respective well.

8. The unmanned wellhead platform according to claim 1, wherein the topside construction is rotated in the horizontal plane approximately 45 degrees relative to corner legs of the jacket.

9. The unmanned wellhead platform according to claim 1, wherein the jacket is an equilateral jacket adjusted for sea depth, metocean data, soil condition, and strength required for the location of the unmanned platform.

* * * * *